US007857544B2

(12) United States Patent
Marsolek et al.

(10) Patent No.: US 7,857,544 B2
(45) **Date of Patent: *Dec. 28, 2010**

(54) EXTENSION PLATE FOR A COMPACTOR

(75) Inventors: John L. Marsolek, Watertown, MN (US); Ryan J. Nelson, Maple Grove, MN (US)

(73) Assignee: Caterpillar Inc, Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/245,499

(22) Filed: Oct. 3, 2008

(65) Prior Publication Data

US 2010/0086354 A1 Apr. 8, 2010

(51) Int. Cl.
*E01C 19/26* (2006.01)
*E01C 19/28* (2006.01)

(52) U.S. Cl. ..... 404/122; 404/103

(58) Field of Classification Search ..... 404/122, 404/128, 103; 164/208; 414/525.2, 525.51; D15/20; 137/355.17; 172/518
See application file for complete search history.

(56) References Cited

U.S. PATENT DOCUMENTS

| | | | | |
|---|---|---|---|---|
| 774,042 | A | 11/1904 | Cooper | |
| 1,417,320 | A | 5/1922 | Hatcher et al. | |
| 3,814,531 | A | 6/1974 | Carnahan et al. | |
| 3,853,148 | A * | 12/1974 | De Vincent et al. | 138/110 |
| 3,882,886 | A * | 5/1975 | Ely et al. | 137/899 |
| 4,172,501 | A | 10/1979 | Murray | |
| 4,270,785 | A | 6/1981 | Farnam | |
| 4,660,845 | A | 4/1987 | Herr | |
| 4,836,740 | A * | 6/1989 | Wagner | 414/686 |
| 4,878,544 | A * | 11/1989 | Barnhart | 172/40 |
| 5,072,800 | A | 12/1991 | Price | |
| 5,232,330 | A * | 8/1993 | Rae et al. | 414/686 |
| 5,333,894 | A | 8/1994 | Mayes | |
| 5,562,175 | A | 10/1996 | Bjorsne et al. | |
| 5,664,909 | A | 9/1997 | Lindgren et al. | |
| D396,431 | S | 7/1998 | Lindgren et al. | |
| D396,727 | S | 8/1998 | Geier et al. | |
| 5,934,824 | A | 8/1999 | Vural | |
| 6,176,666 | B1 | 1/2001 | Osterlund | |
| 6,345,932 | B1 | 2/2002 | Fix | |
| 6,378,279 | B1 * | 4/2002 | Smith et al. | 56/15.5 |
| 6,409,425 | B1 * | 6/2002 | Okabe et al. | 404/117 |
| 6,662,881 | B2 * | 12/2003 | Domann | 172/272 |
| 6,752,360 | B2 * | 6/2004 | Bennett | 248/68.1 |
| 6,829,986 | B2 | 12/2004 | Richter | |
| 6,898,878 | B2 * | 5/2005 | Yoshida et al. | 37/466 |
| 6,902,022 | B2 | 6/2005 | Mathukia | |
| D516,094 | S | 2/2006 | Dotsch et al. | |

(Continued)

OTHER PUBLICATIONS

Dynapac Tandem Asphalt Rollers product brochure.

*Primary Examiner*—Thomas B Will
*Assistant Examiner*—Abigail A Risic

(57) ABSTRACT

An extension plate for use in a compactor includes an elongate body extending between a first surface configured to be coupled to the compactor frame and a second surface configured to be coupled to a support of the compactor. The first surface includes a first opening aligning with an opening into an interior of the compactor. A second opening in at least one of the elongate body or the second surface communicates with the first opening to allow passage of a hose through the extension plate and through the opening in the frame into the interior space.

10 Claims, 4 Drawing Sheets

U.S. PATENT DOCUMENTS 7,186,056 B2 3/2007 Magee
7,192,049 B2 3/2007 Kuerten et al.
7,621,694 B1 * 11/2009 Goodman et al. ..... 404/98
2004/0239092 A1 12/2004 Haringer
2008/0282586 A1 * 11/2008 Wada et al. ..... 37/466

* cited by examiner

EXTENSION PLATE FOR A COMPACTOR

TECHNICAL FIELD

This patent disclosure relates generally to compactors and, more particularly, to extension plates for use with varying widths of drums in compactors.

BACKGROUND

Compactors are typically used to compact material, such as hot asphalt, loose gravel, soil or other material. While compactors can be constructed in a variety of configurations, generally, compactors are vehicles including one or more cylindrically shaped drums that function as wheels that compress material underneath. The drums may have a smooth surface, or may include features, such as teeth, depending on the material to be compacted. For example, in paving roads typically an asphalt paver spreads hot, loose asphalt approximately to a desired grade. The asphalt paver is then followed by a compactor having one or more smooth-surfaced drums, which rolls over the loose asphalt, thereby compacting it to a hard surface. This process may be repeated several times in a series of layers until a final desired grade is reached. By way of further example, gravel or other material may be spread to an approximate grade and then compacted by a compactor.

In order to provide efficient operation of the compactor, it is desirable to provide the operator with visibility of the maximum width of the drum surface. Not only does good visibility of outer drum edges allow an operator to determine precisely the area that he or she is compacting, it allows the operator to ensure that the drum surface remains clean, such that the compactor provides the desired surface quality to the compacted material. For example, because hot asphalt is generally sticky, asphalt can stick to the surface of a drum of the compactor instead of being compacted with the rest of the asphalt, resulting in voids in the asphalt surface. Thus, it is desirable for the operator of the compactor to be able to see the outer drum surface in order to determine whether asphalt or other material is sticking to the drum and, if necessary, take appropriate corrective action. Moreover, compactors often include sprayers that maintain a wet outer drum surface in order to minimize the opportunity for asphalt or other material to stick to the drum. Maximum visibility of the width of the drum surface allows the operator to determine whether the sprayers are functioning properly in order to deter asphalt from adhering to the drum surface.

The drums of compactors are typically operated hydraulically with hoses extending from one or more control valves located in the interior of the compactor to a hydraulic drive unit located in the interior of the drum. To withstand high pressures common in hydraulic systems, hydraulic hoses associated with the hydraulic systems of compactors must be robust, and, as a result, often have limited bending or arcing radii. Depending upon the hose routing, the hydraulic hoses may present obstacles to the visibility of the drum surfaces, particularly toward the outer drum edges.

In order to pass through the frame of the compactor to the control valve, various fittings are often used to compensate for the large bending radius of the hoses as well to allow passage of hydraulic fluid through the frame of the compactor from the compactor's exterior to its interior. For example, bulkhead fittings ("bulkheads" for short) are fittings designed to allow the passage of hydraulic fluid through a wall, such as through a metal plate of a compactor frame. Generally, a bulkhead is a hollow cylinder configured to extend completely through a hole in the wall and connect to a hose at each end, such as by threads, a quick-connect mechanism, or other mechanism. Because hydraulic hoses generally terminate in a fitting, such as a male or female connector, that is wider than the outer diameter of the hose, passing a hose through a hole in the frame without a bulkhead would typically result in undesirable wear to the outer surface of the hose. Rather than bending a hydraulic hose in a wide arc in order to guide it to a bulkhead, 90-degree fittings or other degree bends are often used to allow a hydraulic routing to make sharper turns than would be possible by simply arcing a hose.

The inclusion of multiple fittings in a hydraulic routing increases labor costs associated not only with initial installation, but also with integrity testing and ongoing maintenance. Once the compactor is assembled, each connection of a fitting to the corresponding routing requires testing to ensure that the hydraulic system does not leak. Moreover, each fitting connection is a potential location for a future leak during the life cycle of the compactor. Accordingly, it is desirable to minimize the amount of fittings used. In order to minimize production costs, it is further desirable that frame of a compactor be usable with various widths of rollers.

SUMMARY

The disclosure describes, in one aspect, an extension plate for use in a compactor. The compactor includes a frame defining an interior space and including an opening into the interior space. The compactor also includes a drum having a drum end and a central axis extending through the drum end, a support coupled to the end of the drum, and at least one hose extending from the drum end to the interior space through the opening. The extension plate comprises a body including a first surface configured to be coupled to the frame at a frame connection. The first surface includes a first opening at least partially aligning with the opening into the interior space. The extension plate includes a second surface opposed to the first surface and configured to be coupled to the support at a support connection. An elongate body extends between the first surface and second surface. The body further defines a second opening in communication with the first opening and the first and second openings are adapted for passage of the hose through the extension plate and through the opening in the frame into the interior space.

The disclosure describes, in another aspect, a method of replacing a first drum in a compactor with a second drum having a width different than that of the first drum, the first drum being connected to a frame of the compactor by a support, and wherein a first extension plate is positioned between the support and the frame. The method comprises detaching the support from the frame, removing the first extension plate from between the support and the frame, detaching the support from the first drum, replacing the first drum with the second drum, coupling the support to the second drum, positioning a second extension plate between the support and the frame, and reattaching the support to the frame.

The disclosure describes, in yet another aspect, a compactor comprising a frame coupled to a drum by an extension plate and a support. The frame defines an interior space and at least one opening into the interior space. The drum has a drum end and a central axis extending through the drum end. The support has first and second ends, the first end of the support being coupled to the drum at the central axis. The extension plate is disposed between the second end of the support and the frame. The extension plate includes at least one opening that is at least partially aligned with the at least one frame opening. At least one hose extends from the drum end to the interior space through the extension plate opening and the frame opening.

DETAILED DESCRIPTION

Figure 1:
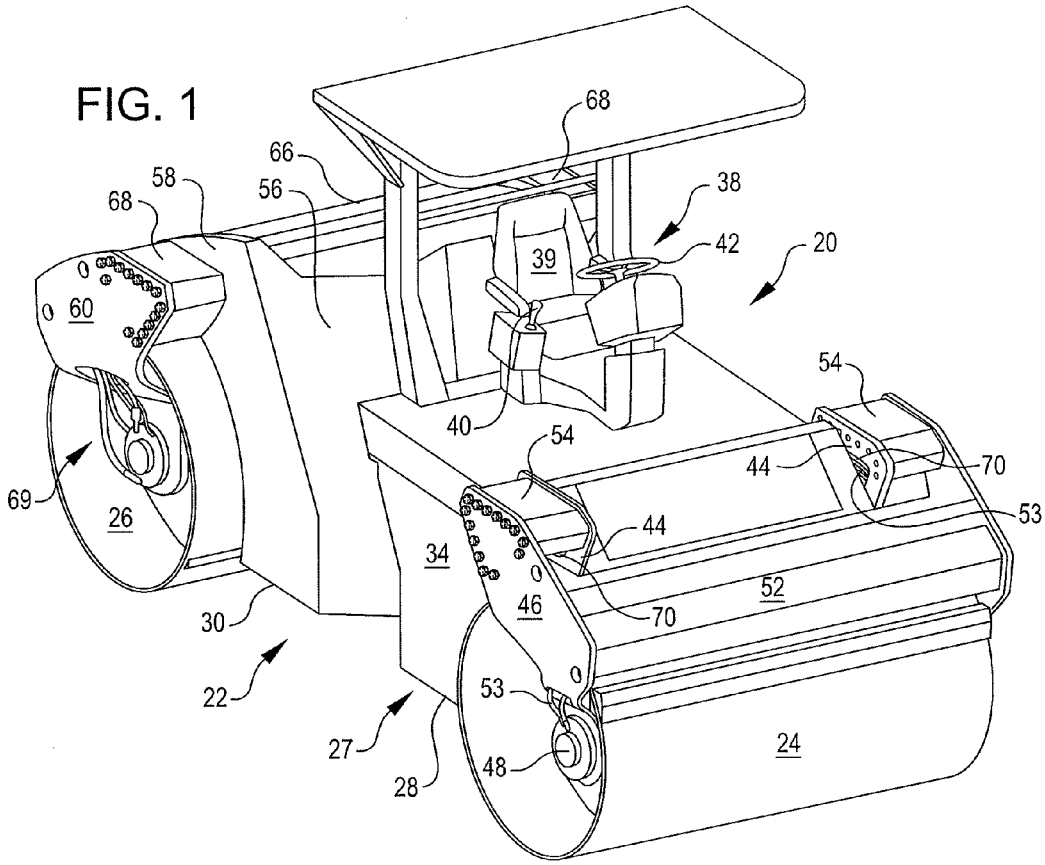
FIG. 1 is a side perspective view of a compactor in accordance with an embodiment.

Referring now to the drawings in which like reference numerals represent like parts throughout several views, FIG. 1 show a compactor 20, in accordance with an embodiment. The compactor 20 includes a chassis 22 supported by a front drum 24 and a rear drum 26. In an embodiment, the chassis 22 includes a frame assembly 27 comprising a front frame 28 and a rear frame 30, each generally having a plurality of metal plates bolted, welded, or otherwise attached to one another so as to form a basic structure for the compactor 20. The front drum 24 and rear drum 26 are cylindrically shaped assemblies configured to rotate about a central axis extending through centers of opposing ends of both the front drum 24 and rear drum 26.

Figure 2:
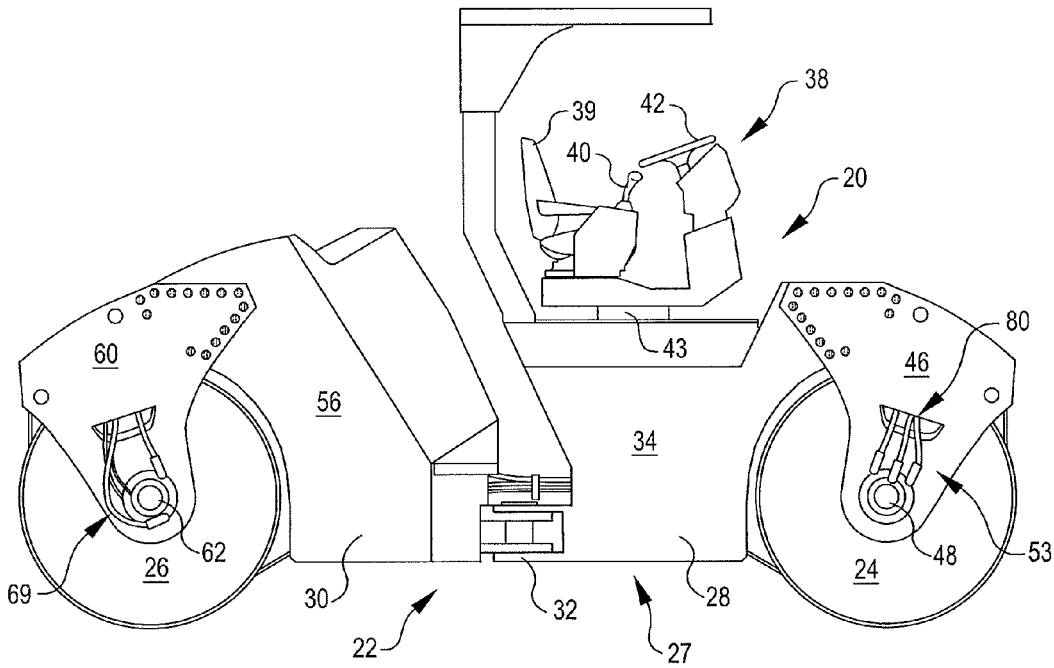
FIG. 2 is a side elevational view of the compactor of FIG. 1.

Referring to FIG. 2, the chassis 22 includes a front frame 28 coupled to a rear frame 30 by a hinged connector 32. While this disclosure may focus on the structure of the front frame 28 and associated structures, in embodiments of the disclosure, the rear frame 30 and associated structures may be similarly constructed, unless specified herein.

The front frame 28 is an arrangement of steel plates welded or otherwise connected together in a configuration that surrounds an interior space or front compartment 34 located between the hinged connector 32 and the front drum 24. In an embodiment, the front compartment 34 is configured to contain various components of the compactor 20, such as one or more of a hydraulic control valve, a hydraulic pump, an engine, electronic equipment, and other equipment (not visible in the figures, but understood by those of skill in the art) commonly found in compactors. An operator station 38 from which an operator of the compactor 20 can operate the compactor 20 may be situated above the front compartment 34. The operator station 38 may include a seat 39, as well as features for operating the compactor 20, such as a motion controller 40, which determines the rotational direction and speed of the front drum 24 and rear drum 26, and a steering wheel 42, which determines the direction of travel of the compactor 20. The operator station 38 may be rotatable on a base 43 to allow an operator to obtain the most desirable vantage point.

Referring to FIG. 1, the front frame 28 additionally includes a pair of substantially vertical front connector plates 44 located at the opposed upper front corners of the front compartment 34. To connect the front frame 28 to the front drum 24, a pair of front supports 46 is coupled to the front connector plates 44, respectively, and rotatably connected to the ends of the front drum 24. The front connector plates 44 and the front supports 46 are each of a structure and thickness that provides adequate strength to support the weight of the compactor 20. More particularly, in the illustrated embodiment, each front support 46 is an elongate steel plate that extends from each front connector plate 44 around an edge of the front drum 24 to an axial portion of the front drum 24. The front supports 46 are rotatably connected to the front drum 24 at front drive units 48, which are hydraulically operated mechanisms for rotating the front drum 24 about its central axis. In this manner, the front supports 46 support the front frame 28 atop the front drum 24. The front frame 28 can also include a front cross member 52, which is an elongate bar or plate of steel or other material of suitable strength horizontally extending between the front supports 46 at a location below and forward of the front connector plates 44. A front hose assembly 53 comprising a plurality of hydraulic hoses for providing hydraulic power to the front drive unit 48 extends from an end of the front drum 24 to the interior of the rear compartment 56, as described in more detail below.

In order to allow a single front frame 28 to be utilized with various widths of front drums 24, spacers may be provided in the form of, for example, front extension plates 54. Such front extension plates 54 extend between the front connector plate 44 and front support 46 in order to increase the distance between the front supports 46, thereby providing for a wider front drum 24 than would be possible without the front extension plates 54.

In an embodiment, the rear frame 30 is configured similarly to the front frame 28, although, as shown in the drawings, the shape, size, and appearance of its various components can differ. In particular, the rear frame 30 is an arrangement of steel plates welded or otherwise connected together in a configuration providing a rear interior space or rear compartment 56 between the rear drum 26 and the hinged connector 32. The rear frame 30 can include two rear connector plates 58 located at upper rear comers of the rear compartment 56. A rear support 60 extends from each rear connector plate 58 to an end of the rear drum 26 on a corresponding side of the compactor 20. A rear extension plate 68, similar to the front extension plate 54, can be located between the rear connector plate 58 and the corresponding rear support in a manner similar to the front extension plate 54. A hydraulically-operated rear drive unit 62 extending from each end of the rear drum 26 for rotating the rear drum 26 can be included within the rear drum 26. A rear cross member 66 can extend horizontally between the rear supports 60 at a location below and behind the rear connector plates 58. A rear hose assembly 69 can extend from an axial portion of the rear drum 26 at the rear drive unit 62 to the interior of the rear compartment 56 similar to the routing of the front hose assembly 53, described above.

Figure 3:
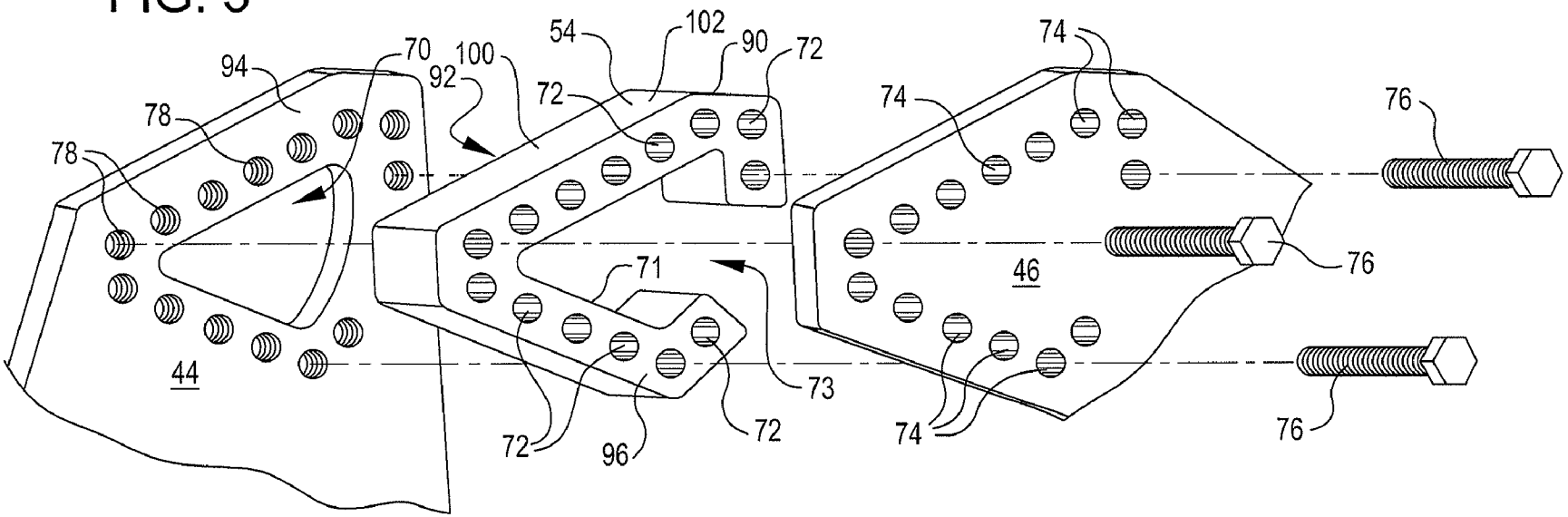
FIG. 3 is a fragmentary, exploded view of a connection between a support and a connector plate of the compactor of FIG. 1.

Returning to the construction of the front frame 28 and related structures, in order to allow the passage of hydraulic hoses of the front hose assembly 53 from the front compartment 34 to the ends of the front drum 24, each of the front connector plates 44 are provided with a cutout or opening 70 therethrough, as may be seen in FIG. 3. Should extension plates 54 be utilized, the front extension plates 54 may likewise define an opening 71 that may be disposed adjacent the opening 70 of the front connector plates 44. In the illustrated embodiment, the front extension plate 54 is likewise provided with a second opening 73 extending through an edge of the front extension plate 54. In this way, when the extension plate 54 is located proximally to the connector plate 44 and the front support 46, a passageway is defined by the opening 70 in the front connector plate 44 and the openings 71, 73 in the front extension plate 54 that provides a continuous opening therethrough for the passage of hydraulic hoses, as may be better seen in FIGS. 4-6. In the illustrated embodiment, the opening 70 of the front connector plate 44 and the opening 71 of the front extension plate 54 are of similar sizes. It will be appreciated, however, that the openings 70, 71 need not align exactly or be of the same size, so long as an appropriate passageway is provided for the passage of the hoses of the front hydraulic hose assembly 53.

The front extension plates 54 may be of any suitable shape and size, and fabricated by any appropriate method. Referring to FIG. 3, the extension plate 54 generally includes a body 90 having a first surface 92 adapted to be disposed adjacent the connector plate 44 of the front frame 28 at a frame connection 94, a second surface 96 adapted to be disposed adjacent the support 46 at a support connection 98, and an elongate body 100 have a side surface 102 extending therebetween. The first opening 71 of the extension plate 54 extends through the first surface 92. In the illustrated embodiment, the second opening 73 extends through the side surface 102 of the extension plate 54. In an alternate embodiment, however, the second opening 73 may extend through the second surface 96. Although the first and second surfaces 92, 96 are substantially parallel and each substantially planar in the illustrated embodiment, the surfaces 92, 96 may be disposed at an angle to one another and/or may present non-planar faces so long as they may appropriately mate with the connector plate 44 and the support 46, respectively. In the illustrated embodiment, the front extension plate 54 has a shape resembling a triangle, although the front extension plate 54 can be any suitable design, such as, for example, a square, circle, or other shape.

The extension plates 54 may be formed by of any appropriate material and fabricated by any appropriate method. By way of example only, the extension plates 54 may be stamped, casted, or machined from steel or any other appropriate material.

The front connector plates 44 and front support plates 46, or the front connector plates 44, front extension plates 54, and front support plates 46 may be coupled together by any appropriate arrangement. In the illustrated embodiment, each is provided with a plurality of parallel bores (extension plate bores 72, support bores 74, and connector bores 78), the bores 72, 74, 78 being axially aligned to permit the placement of appropriate fasteners. While the bores 72, 74, 78 may be disposed in any appropriate configuration so long as the joint is adequately secured, the bores 72, 74, 78 of the illustrated embodiment are generally disposed about the opening 71 in the front extension plate 54 and the opening 70 through the front connector plate 44. It will be noted that the inclusion and coupling of the front extension plates 54 to the front connector plates 44 and the front support plates 46 may provide additional strength to the front connector plates 44 in the vicinity of the openings 70.

Although alternate fasteners may be used, in the illustrated embodiment, threaded bolts 76 are utilized and the connector bores 78 are internally threaded. In this way, the threaded bolts 76 extend through the support bores 74 and the extension plate bores 72, and thread into corresponding threaded bores 78 in the front connector plate 44 to secure the front support 46 and the front extension plate 54 to the front frame 28. In an alternate embodiment, the bolts 76 may extend entirely through the support bores 74, the extension plate bores 72, and the connector bores 78, and internally threaded nuts (not shown) may be disposed on the ends of the bolts 76.

As noted above, the front extension plate 54 can vary in width to accommodate front drums 24 of differing widths. For instance, if a narrow drum is desirable so that the compactor 20 can maneuver in smaller places or the like, relatively narrow front extension plates 79 can be utilized to minimize the distance between the front supports 46, as shown, for example, in FIG. 4. It will be appreciated that the narrow extension plate 79 has a width slightly larger than the width of a hydraulic hose of the hose assembly 53 in the illustrated embodiment, thereby allowing passage of the front hose assembly 53 while still allowing the use of a relatively narrow front drum 24. In contrast, if it is desirable for the compactor 20 to utilize a wider front drum 24, the distance between the front supports 46 can be increased by utilizing a wider front extension plate 54 to accommodate a wider drum, as shown, for example, in FIGS. 5-7.

While selectively detachable fasteners such as threaded bolts 76 and corresponding threaded holes 78 may be utilized, in an alternate embodiment, the extension plate, such as the thin extension plate 79, may be permanently welded or otherwise attached to the front connector plate 44 and/or the front support 46 or both. When a thin extension plate 79, such as in the arrangement illustrated in FIG. 4, is welded to only one or the other of the front connector plate 44 or the front support 46, however, additional extension plates 54, 79 may be added if a wider drum 24 is to be utilized.

The rear connector plates 58, rear supports 60, and rear extension plates 68, in an embodiment, are configured similarly to their similarly named counterparts described above. As with the similarly named front components, the width of the rear extension plates 68 can be varied in order to vary the distance between the rear supports 60 and, therefore, to accommodate rear drum 26 widths of varying sizes.

Figure 5:
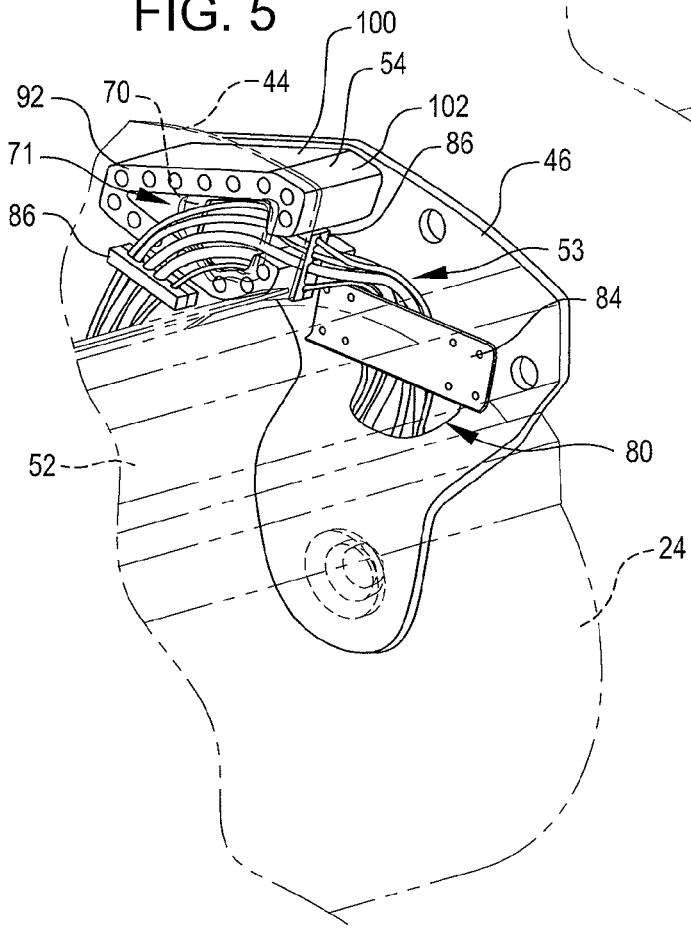
FIG. 5 is a, fragmentary, side perspective view of a front corner of the compactor of FIG. 1, the compactor incorporating a wider drum than shown in FIG. 4.
Figure 6:
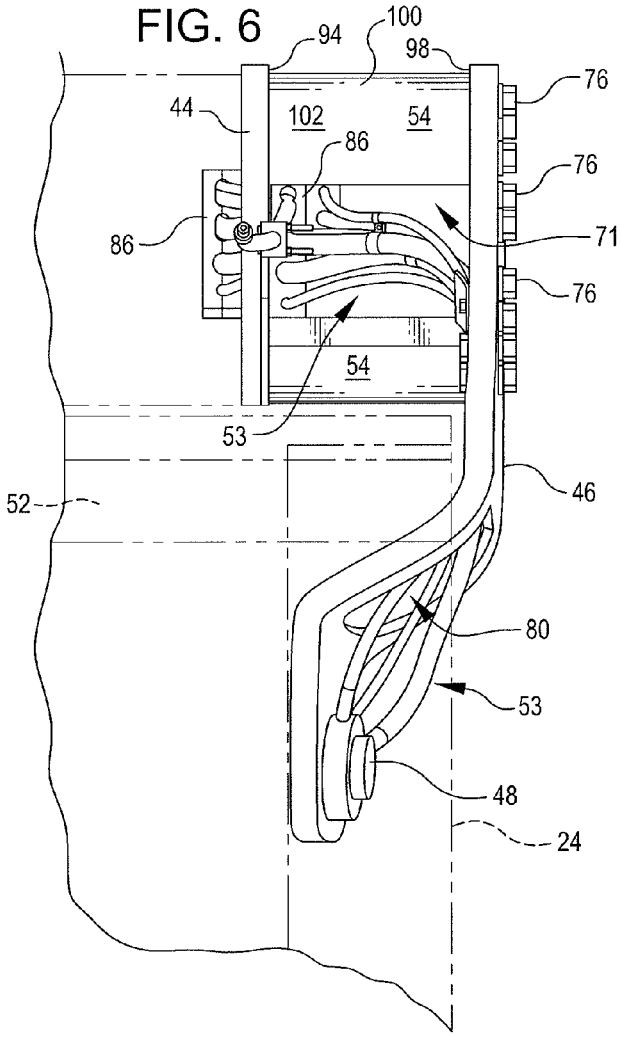
FIG. 6 is a fragmentary, front view of the front corner shown in FIG. 5.

Returning now to the front frame 28 and associated structures, FIGS. 5 and 6 show the front connector plate 44, front extension plate 54, and the front support 46 in greater detail. In order to accommodate the front hose assembly 53, the front support 46 may be provided with a channel, cutout, or support opening 80 to allow passage of the hoses of the front hose assembly 53 therethrough. In the illustrated embodiment, the opening 80 is provided in a middle portion of the front support 46 at the location where the front support 46 bends toward the interior of the front drum 24. In this way, the support opening 80 allows the front hose assembly 53 to pass through the front support 46 from the front drive unit 48 to the front extension plate 54 and front connector plate 44, and on to the interior of the front compartment 34. In particular, in an embodiment, the front hose assembly 53 proceeds from various ports of the front drive unit 48 through the support opening 80, through the openings 73, 71, in the extension plate 54, and through the opening 70 in the connector plate 44. The front hose assembly 53 then proceeds to the portion of the hydraulic system of the compactor 20 located inside the front compartment 34.

Figure 4:
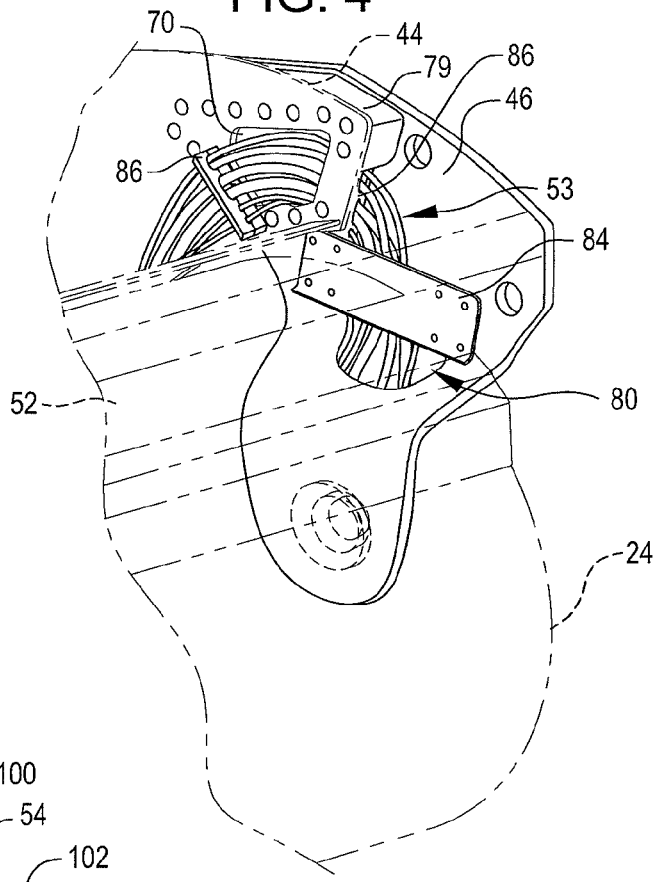
FIG. 4 is a fragmentary, side perspective view of a front corner of the compactor of FIG. 1.

In order to maintain the individual hoses of the front hose assembly 53 in substantially steady positions, one or more retainer plates 84 or hose brackets 86 may be provided, as shown, for example, in FIGS. 4-6. For example, in order to deter the hoses of the front hose assembly 53 from contacting and wearing upon the edge of the front drum 24, a retainer plate 84 may be provided that extends across the support opening 80, urging the hoses into the opening 80. The retainer plate 84 and the hose brackets 86 may be of any appropriate designs that maintains the hoses in the desired configuration, and may optionally include any mechanisms capable of securing one or more hoses to an object. For example, as shown in FIG. 5, in order to maintain the front hose assembly 53 in a configuration wherein the front hose assembly 53 proceeds from the end of the front drum 24 through the connector plate opening 70 without contacting edges of the various components of the compactor 20, a hose bracket 86 can be located at an opening 73 of the front extension plate 54 and just below the connector plate opening 70. In addition, the hose brackets 86 may also be used to minimize the opportunity for the individual hoses of the front hose assembly 53 to contact each other. By preventing each hose of the hose assembly 53 from contacting other objects, each hose is deterred from rubbing against the various components of the compactor 20 as the compactor 20 vibrates and moves during its operation, thereby minimizing wear and lessening any opportunity for holes to develop in the hoses of the front hose assembly 53.

In this manner, a routing for the front hose assembly 53 is provided that proceeds directly from the front drive unit 48 to the interior of the rear compartment 56 and that is free from sharp bends of the hoses of the front hose assembly 53. Consequently, hoses of the front hose assembly 53 are able to pass from the front drive unit 48 to the interior of the front compartment 34 continuously without fittings such as bulkheads and 90-degree bends and without protruding a large distance from the compactor 20 in order to accommodate the hoses large bending radii. However, fittings may be used, if desired.

Figure 7:
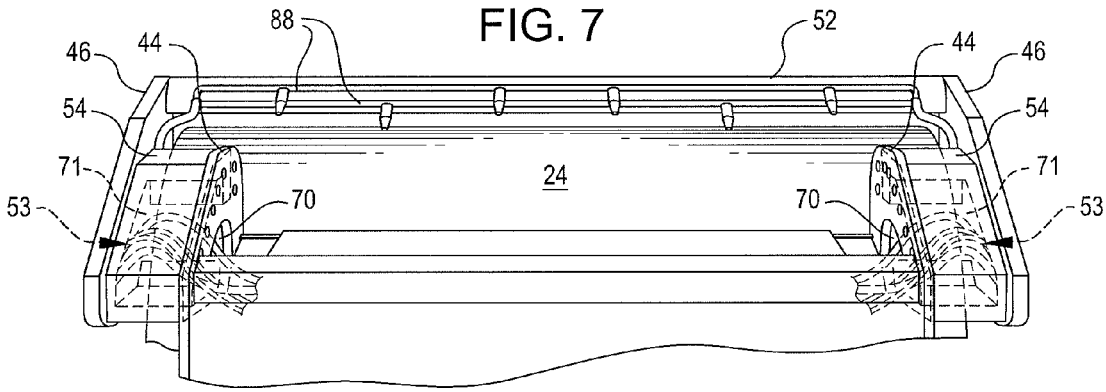
FIG. 7 is a view of a portion of a front drum of the compactor of FIG. 1 as shown from the vantage point of an operator of the compactor.

Routing the hose assemblies 53, 69 in the manner described above may provide additional advantages in that visibility of the surface of the drums 24, 26 may be substantially increased. As an example, FIG. 7 shows a forward-looking view from the perspective of an operator located in the operator station 38 of the compactor 20. To the operator, a portion of the upper surface of the front drum 24 extending substantially completely across the front drum 24 is visible as the front hose assembly 53 extends clear of the portion of the operator's field of vision including the portion of the upper drum surface. Therefore, the operator can readily determine whether the front drum 24 is performing as desired. For instance, the operator can readily see if asphalt sticks to the front drum 24 and can continually ensure that a spray assembly 88 is functioning properly to keep the complete surface of the front drum 24 wet.

In other embodiments, the other front hose assembly 53 and/or the rear hose assemblies 69 are routed in a manner similar to that described above. Because the rear frame 30 is configured similarly to the front frame 28 and because the rear frame 30 is connected to the rear drum 26 in a manner similar to that in which the front frame 28 is connected to the front drum 24, the advantages described above in connection to the front frame 28 are present in the rear frame 30. Notably, the operator of the compactor 20 is able to see a portion of the rear drum 26 extending completely across the rear drum 26.

INDUSTRIAL APPLICABILITY

The disclosed extension plate arrangement may facilitate the use of a single compactor chassis 22 with varying widths of drums 24, 26 in compactors 20.

In one or more embodiments, because the front hose assembly 53 proceeds to an internal hydraulic system in the front compartment 34 from both ends of the front drum 24 smoothly through the front supports 46 and into the front compartment 34 via the connection of the front supports 46 to the front connector plates 44, the front hose assembly 53 proceeds in a manner that may not impede the operator's view of the front drum 24 surface. Likewise, as the rear hose assembly 69 proceeds similar to the front hose assembly 53, the rear hose assembly 69 may not impede the operator's view of the rear drum 26. As a result, the operator may easily determine whether the rear spray assembly is functioning properly and/or whether asphalt or other material is adhering to the rear drum 26 surface.

In addition, in one or more embodiments, as the front hose assembly 53 and rear hose assembly 69 are able to proceed smoothly into the interior of the front compartment 34, the need for bulkheads and other fittings is greatly reduced when compared to existing compactor designs. Because fittings in hydraulic lines are a common source of hydraulic system leaks, the present disclosure may provide reduced probability that a hydraulic leak will occur in the front hose assembly 53 or rear hose assembly 69. A reduced number of bulkheads and other fittings also may provide an advantage in that maintenance of the compactor 20 involving the front hose assembly 53 or rear hose assembly 69, as the number of parts to be assembled and/or disassembled may be reduced.

If it is desired that the front drum 24 be replaced with a narrower drum, for example upon determination that the compactor 20 will be more useful in one or more applications with a narrower front drum 24 width, the front extension plates 54 can replaced with thinner extension plates, such as the thin extension plates 79 shown in FIG. 4. Generally, replacement of the front extension plates 54 can begin with removal of the bolts 76 and detachment of the hoses of the front hose assembly 53 from the front drive unit 48. The front supports 46 are separated from the front connector plates 44 and from the respective ends of the front drum 24. The front drum 24 is then replaced with a narrower drum and the front supports 46 are then reattached to the front connector plates 44, with an appropriate extension plate between the front supports 46 and their respective front connector plates 44, and the front supports are attached to respective ends of the narrower drum. The rear drum 26 can be replaced with a narrower drum in a similar manner.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An extension plate in a compactor, the compactor having right and left lateral sides and comprising a frame defining an interior space and including at least one substantially vertical connector plate disposed along at least one of the right or left lateral side, the connector plate including an opening into the interior space, a drum having a drum end and a central axis extending through the drum end, and a support coupled to the end of the drum, and at least one hose extending from the drum end to the interior space through the opening, the extension plate comprising a body including a first surface coupled in a substantially vertical configuration to the connector plate of the frame at a frame connection, the first surface including a first opening, the first opening of the first surface at least partially aligning with the opening into the interior space;

a second surface opposed to the first surface, the second surface coupled to the support at a support connection; and an elongate body extending between the first surface and second surface;

the body further defining a second opening in communication with the first opening, the hose passing through the first and second openings and through the opening in the frame into the interior space.

2. The extension plate of claim 1 wherein the second opening extends through the second surface.

3. The extension plate of claim 1 wherein the elongate body includes a side extending between the first and second surfaces, and the second opening extends through the side.

4. The extension plate of claim 1 wherein at least one of the frame or the support include a plurality of bores therethrough and the body defines a plurality of bores disposed coaxially with the bores of the at least one of the frame or the support, the extension plate further including a plurality of fasteners extending through the plurality of bores of the at least one of the frame or the support and into the plurality of bores in the body, respectively.

5. The extension plate of claim 1 wherein the body includes a plurality of bores that extend completely through the extension plate from the first surface to the second surface, the holes receiving fasteners extending from the frame connection to the support connection to secure the support, the frame, and the extension plate together.

6. The extension plate of claim 1, wherein the extension plate is formed by at least one of casting, stamping, or machining.

7. The extension plate of claim 1, wherein the first surface and second surface are both planar.

8. The extension plate of claim 7, wherein the first surface and second surface are parallel.

9. The extension plate of claim 1 wherein the drum has opposite ends disposed along the right and left lateral sides of the compactor, and wherein the compactor frame has at least two substantially vertical connector plates disposed along the respective right and left lateral sides of the compactor, at least two supports coupled to the opposite ends of the drum, and wherein the extension plate is coupled to one of the connector plates and one of the support plates disposed along either the right or left lateral side of the compactor, and further includes a second extension plate coupled to the connector plate and support plate disposed along the other of the right or left lateral side of the compactor.

10. The extension plate of claim 1 wherein the drum has two ends and a length between the ends, and wherein the extension plate allows the attachment of varied lengths of drums to the frame.

* * * * *